US009659720B2

(12) United States Patent
Lutz et al.

(10) Patent No.: US 9,659,720 B2
(45) Date of Patent: May 23, 2017

(54) MACHINE TOOL SWITCHING DEVICE

(75) Inventors: Manfred Lutz, Filderstadt (DE); Achim Trick, Sielmingen (DE); Thomas Schomisch, Filderstadt (DE); Florian Esenwein, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 208 days.

(21) Appl. No.: 14/115,081

(22) PCT Filed: Mar. 15, 2012

(86) PCT No.: PCT/EP2012/054573
§ 371 (c)(1),
(2), (4) Date: Oct. 31, 2013

(87) PCT Pub. No.: WO2012/150076
PCT Pub. Date: Nov. 8, 2012

(65) Prior Publication Data

US 2014/0080388 A1 Mar. 20, 2014

(30) Foreign Application Priority Data

May 4, 2011 (DE) ..... 10 2011 075 196

(51) Int. Cl.
*B24B 23/02* (2006.01)
*H01H 9/22* (2006.01)
*G05G 5/06* (2006.01)

(52) U.S. Cl.
CPC ..... *H01H 9/22* (2013.01); *B24B 23/022* (2013.01); *B24B 23/028* (2013.01); *G05G 5/06* (2013.01)

(58) Field of Classification Search
CPC ..... B24B 23/022; B24B 23/028; B24B 23/02; H01H 9/02; H01H 9/06; H01H 9/22; G05G 5/06
(Continued)

(56) References Cited

U.S. PATENT DOCUMENTS 3,847,233 A * 11/1974 Glover ..... A01G 3/053 173/170
4,280,026 A * 7/1981 Alessio ..... H01H 3/20 200/321

(Continued)

FOREIGN PATENT DOCUMENTS

CN 201376223 Y 1/2010
CN 201471264 U 5/2010

(Continued)

OTHER PUBLICATIONS

International Search Report corresponding to PCT Application No. PCT/EP2012/054573, mailed Aug. 30, 2012 (German and English language document) (5 pages).

*Primary Examiner* — Eileen Morgan

(74) *Attorney, Agent, or Firm* — Maginot, Moore & Beck LLP

(57) ABSTRACT

A machine tool switching device, in particular for portable machine tools, includes at least one switching unit that has at least one movably mounted operating element for actuating a mechanical, electrical, and/or electronic switching element. The machine tool switching device further includes at least one blocking device for blocking at least one movement of the operating element. The blocking device includes at least one movably mounted release element provided to lift the blockage of the operating element. The release element is mounted on the operating element so as to be movable in a translatory manner.

20 Claims, 5 Drawing Sheets

(58) Field of Classification Search
USPC ..... 451/344, 359
See application file for complete search history.

(56) References Cited

U.S. PATENT DOCUMENTS

| | | | | | |
|---|---|---|---|---|---|
| 4,592,144 | A * | 6/1986 | Tolbert | B23D 49/167 | 200/291 |
| 4,973,807 | A * | 11/1990 | Stabler | H01H 9/06 | 200/321 |
| 5,447,206 | A * | 9/1995 | Coleman | A01D 34/90 | 173/170 |
| 6,274,828 | B1 * | 8/2001 | Chu | H01H 13/08 | 200/321 |
| 6,469,269 | B1 * | 10/2002 | Jong | H01H 9/06 | 200/321 |
| 6,555,773 | B1 * | 4/2003 | Broghammer | H01H 9/06 | 200/321 |
| 6,610,946 | B2 * | 8/2003 | Covell | H01H 9/06 | 200/17 R |
| 7,044,235 | B2 * | 5/2006 | Lin | B24B 23/026 | 173/169 |
| 7,147,463 | B2 * | 12/2006 | Wong | F23Q 2/164 | 431/153 |
| 7,398,834 | B2 * | 7/2008 | Jung | B25D 16/006 | 173/11 |
| 8,511,399 | B2 * | 8/2013 | Kunz | B25D 17/00 | 173/170 |
| 8,716,908 | B2 * | 5/2014 | Takeda | B24B 23/02 | 310/47 |
| 2011/0227429 | A1 * | 9/2011 | Takeda | B24B 23/02 | 310/50 |

FOREIGN PATENT DOCUMENTS

| | | | |
|---|---|---|---|
| CN | 101802950 | A | 8/2010 |
| CN | 102015218 | A | 4/2011 |
| RU | 67 788 | U1 | 10/2007 |
| SU | 1193633 | A | 11/1985 |
| SU | 1383285 | A1 | 3/1988 |
| WO | 01/66314 | A1 | 9/2001 |

* cited by examiner

MACHINE TOOL SWITCHING DEVICE

This application is a 35 U.S.C. §371 National Stage Application of PCT/EP2012/054573, filed on Mar. 15, 2012, which claims the benefit of priority to Serial No. DE 10 2011 075 196.3, filed on May 4, 2011 in Germany, the disclosures of which are incorporated herein by reference in their entirety.

BACKGROUND

Machine tool switching devices, in particular for portable machine tools which have a switching unit which has a movably mounted control element for actuating a mechanical, electric and/or electronic switching element and which include a blocking device for blocking a movement of the control element which has a movably mounted release element which is provided for the purpose of lifting the block of the control element, are already known.

SUMMARY

The disclosure proceeds from a machine tool switching device, in particular for portable machine tools, said machine tool switching device having at least one switching unit which has at least one movably mounted control element for actuating a mechanical, electric and/or electronic switching element, and having at least one blocking device for blocking at least one movement of the control element, said blocking device having at least one movably mounted release element which is provided for the purpose of lifting the block of the control element.

It is proposed that the release element is mounted so as to be movable in a translatory manner. The term "portable machine tool" is to be understood, in this case in particular, as a machine tool, in particular a manual machine tool which is able to be transported by an operator without a transporting machine. The weight of the portable machine tool is in particular less than 40 kg, in a preferred manner less than 20 kg and in a particular preferred manner less than 10 kg. The term "switching unit" is to define, in this case in particular, a unit which is provided for the purpose of modifying a state of a unit which is higher-ranking than the switching unit as a result of an actuation of at least the control element. In a particularly preferred manner, the switching unit is provided for the purpose of enabling and/or interrupting a power supply to a motor unit as a result of an actuation of the control element which acts on the switching element of the switching unit which is realized as a mechanical, electric and/or electronic switch and/or key. The switching element, which is realized as a mechanical, electric and/or electronic switch and/or key, is preferably arranged in a circuit between a power supply line, such as, for example a cable on which a plug is arranged for connection to a plug socket, and a consumer of the portable machine tool, such as, for example, a motor unit which is realized as an electric motor. In this context, the term "provided" is to define specially equipped and/or specially designed.

The term "mounted so as to be movable/movably mounted" is to define, in particular in this case, a bearing arrangement of an element, the element, in particular uncoupled from elastic deformation of the element, having a possibility of movement along at least one section greater than 1 mm, in a preferred manner greater than 5 mm and in a particularly preferred manner greater than 10 mm and/or a possibility of movement about at least one axis by an angle greater than 5°, in a preferred manner greater than 10° and in a particularly preferred manner greater than 20°. A "blocking device" is to be understood, in this case in particular, as a device which is provided for the purpose of preventing as extensively as possible, at least in one operating state, a movement of a movably mounted component along at least one section and/or about at least one axis by means of a mechanical, electric and/or electronic block. In a preferred manner the blocking device is provided for the purpose of preventing as extensively as possible, at least in one operating state of the blocking device, a movement of the movably mounted control element by means of a mechanical block. However, it is also conceivable for the blocking device to prevent a movement of the control element as extensively as possible at least in one operating state of the blocking device by means of introducing an electromagnetic force and/or introducing a permanent magnetic force, such as for example by means of displaceable magnets, onto the control element. By means of the development of the machine tool switching device according to the disclosure, a blocking device which can be operated in a comfortable manner can be advantageously achieved. The blocking device can be advantageously arranged in a space-saving manner on the control element.

In addition, it is proposed that the release element is mounted on the control element so as to be movable in a translatory manner. However, it is also conceivable for the release element to be mounted so as to be movable in a translatory manner in a region of a housing of the portable machine tool directly adjoining the control element. By means of the arrangement of the release element on the control element, a comfortable operability of the release element can be achieved in an advantageous manner. By engaging the control element for example by means of one finger of a hand of the operator, an operator can actuate the release element in order consequently to lift a block on a movement of the control element.

In addition, it is proposed that the release element is arranged at least in part in a recess of the control element. A "recess" is to be understood, in particular in this case, as a region of the control element which, compared to adjacent regions, in particular compared to immediately adjoining regions, has a smaller material thickness, in particular a material thickness of 0 mm. In a particularly preferred manner, the edge regions defining the recess are provided for the purpose of guiding the release element. The release element, which is arranged in the recess, preferably extends at least by way of a part region of the release element along a direction which extends at least substantially at right angles to a control face of the control element over the control face of the control element. The term "substantially at right angles" is to define, in this case in particular, an alignment of a direction in relation to a reference direction, the direction and the reference direction, in particular when viewed in one plane, enclosing an angle of 90° and the angle having a maximum deviation of in particular less than 8°, in an advantageous manner less than 5° and in a particularly advantageous manner less than 2°. However, it is also conceivable for the release element, in an alternative development, to terminate at least substantially flush with the control face along the direction extending at right angles to the control face. A "control face" is to be understood, in this case in particular, as a face of the control element onto which an operator exerts a force for actuating the control element. The control face of the control element is preferably arranged on a side of the control elements which is remote from the mechanical, electric and/or electronic switching element. Through the partial arrangement of the release element in the recess of the control element, a sturdy arrangement of the release element can be achieved in an advantageous manner. If the portable machine tool which has the machine tool switching device were to fall, the release element can be supported in an advantageous manner on the control element and consequently can be protected from damage during the fall.

In an advantageous manner, the blocking device has at least one blocking element for blocking a movement of the control element in dependence on a position of the release element which is fixed on the release element. In a preferred manner, the blocking element is realized as a mechanical blocking element which is provided for the purpose of blocking a movement of the control element as a result of direct contact in a blocking position with a stop of the blocking device which is arranged in a housing of the portable machine tool. However, it is also conceivable for the blocking device to include a plurality of blocking elements which are provided for the purpose of blocking a movement of the control element by way of stops of the blocking device which are arranged in the housing of the portable machine tool. As a result, in an advantageous manner the control element can be prevented from bending or bending can be reduced as extensively as possible where an operator introduces a force onto the control element when the release element is not actuated. A number of stops which are arranged in the housing corresponds in a preferred manner to a number of blocking elements. In this connection, the blocking elements can be fixed on the release element, distributed uniformly and/or non-uniformly. In a particularly preferred manner, the blocking element is moved out of the blocking position and/or into the blocking position by means of a movement of the release element. A "blocking position" is to be understood, in this case in particular, as a position of the blocking element in which a movement of the control element is prevented as extensively as possible by means of the blocking element. In an advantageous manner, the blocking element is connected to the release element by means of a force-fitting, form-fitting and/or positively-bonding connection. In a particularly preferred manner, the blocking element is fixed on the release element by means of a latching connection. However, it is also conceivable for the blocking element to be fixed on the release element by means of a screw connection. The blocking element can preferably be moved in a translatory manner together with the release element. A space-saving development of the machine tool switching device according to the disclosure can be achieved in an advantageous manner. As extensive as possible a block of a movement of the control element can be achieved in a structurally simple manner.

In an alternative development of the machine tool switching device according to the disclosure, the blocking element is realized integrally with the release element. The term "integrally" is to be understood in particular as at least connected in a positively-bonded manner, for example by means of a welding process, an adhesive process, an injection process and/or another process which appears sensible to the expert, and/or to be understood, for example, as molded advantageously in one piece, such as for example by being produced from a casting and/or by being produced using a single or multiple component injection molding method and advantageously from one single blank. Additional components to form a connection between the blocking element and the release element can be advantageously dispensed with.

In addition, it is proposed that the blocking device has at least one spring element which is provided for the purpose of acting upon the release element with a spring force at least in one direction. A "spring element" is to be understood in particular as a macroscopic element which has at least one extension which is elastically modifiable in a normal operating state by at least 10%, in particular by at least 20%, preferably by at least 30% and in a particularly advantageous manner by at least 50%, and which generates in particular a counterforce which is dependent on a change in the extension and is preferably proportional to the change. An "extension" of an element is to be understood in particular as a maximum distance between two points of a perpendicular projection of the element onto a plane. A "macroscopic element" is to be understood in particular as an element with an extension of at least 1 mm, in particular of at least 5 mm and preferably of at least 10 mm. In a preferred manner, the spring element is provided for the purpose of acting upon the release element and/or the blocking element with a spring force in the direction of the blocking position. As a result, it can be advantageously achieved that the release element and/or the blocking element are moved into the blocking position once an introduction of force onto the control element as a result of the spring force has been lifted.

In an advantageous manner, the blocking device has at least one further release element which is arranged together with the release element on the control element so as to be movable in a translatory manner. The release element and the further release element, when viewed along a longitudinal direction of the control element, are arranged spaced apart in relation to one another. In a particularly preferred manner, the release element and the further release element are connected together by the blocking element. Comfortable actuation of the blocking device at different positions of the control element can be achieved in an advantageous manner.

In an alternative development of the machine tool switching device according to the disclosure it is proposed that along a longitudinal direction of the control element the release element has an extension which is greater than 20% of an overall extension of the control element along the longitudinal direction. In a preferred manner, the release element extends along the longitudinal direction over more than 40% and in a particularly preferred manner over more than 60% of an overall extension of the control element. In this connection, on a side of the release element which is remote from the blocking element, in an advantageous manner the release element has a gripping structure, such as for example a ribbed surface structure, a surface with finger troughs and/or a different gripping structure which appears sensible to an expert. In an advantageous manner the release element is able to be controlled in a comfortable manner over a large region of the overall extension of the control element along the longitudinal direction.

In addition, it is proposed that the control element is rotatably mounted. In a particularly preferred manner, the control element is mounted so as to be rotatable about an axis of rotation which extends parallel to the longitudinal direction of the control element. The control element, in this connection, preferably includes bearing continuations, which are arranged in a mounted state of the control element in bearing recesses of a housing, in particular in a handle and/or handle region, of the portable machine tool. In this connection, the control element, preferably along the longitudinal direction of the control element, has an extension which is in particular greater than 40%, in a preferred manner greater than 60% and in a particularly preferred manner greater than 80% of an overall extension of a handle and/or of a handle region of the portable machine tool which extends along the longitudinal direction of the control element. A slight clamping tendency and comfortable actuation of the control element can be achieved in an advantageous manner.

In addition, the disclosure proceeds from a portable machine tool with at least one machine tool switching device according to the disclosure. In a particularly preferred manner, the portable machine tool is realized as a right angle grinding tool. However, it is also conceivable for the portable machine tool to have a different development which appears sensible to a expert, such as for example as a manual planing tool, as a multi-functional machine tool, as a portable milling tool, as a grinding tool and/or as an electrically-operated garden instrument. A high level of operating comfort for an operator of the portable machine tool can be achieved in an advantageous manner.

The machine tool switching device according to the disclosure is not be to be restricted in this connection to the above-described application and embodiment. In particular, for fulfilling a method of operation described herein, the machine tool switching device according to the disclosure can have a number of individual elements, components units and apparatuses which deviates from a number named herein.

BRIEF DESCRIPTION OF THE DRAWINGS

Further advantages are produced from the following description of the drawings. Exemplary embodiments of the disclosure are shown in the drawings. The drawings, the description and the claims include numerous features in combination. The expert will also consider the features individually in an expedient manner and combine them to form sensible further combinations.

In which drawings.

DETAILED DESCRIPTION

Figure 1:
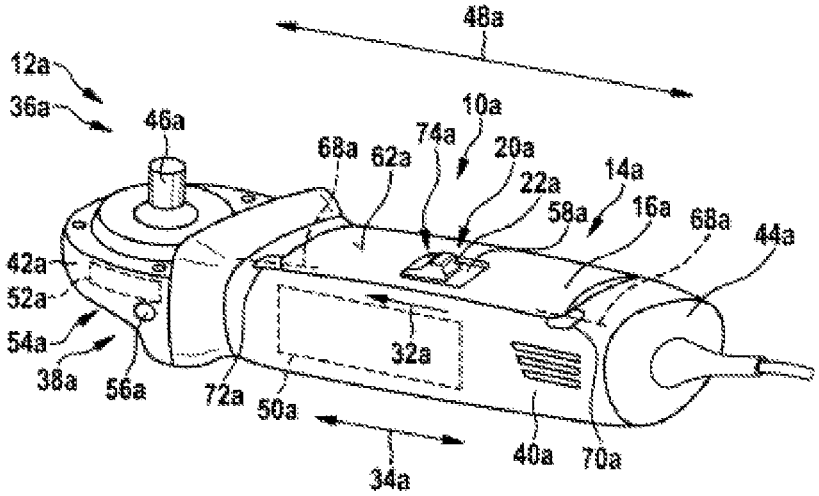
FIG. 1 shows a schematic representation of a portable machine tool according to the disclosure with a machine tool switching device according to the disclosure.

FIG. 1 describes a portable machine tool 12*a* which is realized as a right angle grinding tool 36*a* with a machine tool switching device 10*a*. The right angle grinding tool 36*a* has a machine tool housing 38*a* which includes a gear housing 42*a* and a motor housing 44*a*. In addition, the right angle grinding tool 36*a* has a main handle 40*a* which is formed by the motor housing 4*a*. The main handle 40*a* extends proceeding from the gear housing 42*a* in a direction which is remote from the gear housing 42*a* and extends at least substantially parallel to a main extension direction 48*a* of the right angle grinding tool 36*a*. In this connection, the main handle 40*a* has a development which is at least substantially cylindrical. However, it is also conceivable for the main handle 40*a* to have a different development which appears sensible, in particular ergonomically sensible, to an expert. The motor housing 44*a* is provided for receiving a drive unit 50*a* of the right angle grinding tool 36*a*. The gear housing 42*a* is provided for receiving a driven unit 52*a* of the right angle grinding tool 36*a*, which includes a drive spindle 46*a* for a rotating drive of a processing tool (not shown in any detail here). An auxiliary handle fastening device 54*a* is fastened on the gear housing 42*a*. The auxiliary handle fastening device 54*a* has a plurality of auxiliary handle receiving elements 56*a* (only one auxiliary handle receiving element 56*a* can be seen in FIG. 1) which are arranged distributed uniformly along a circumferential direction on the gear housing 42*a*. The auxiliary handle receiving elements 56*a* are provided for the purpose of receiving a fastening region of a removable auxiliary handle (not shown here in any detail). The fastening region of the auxiliary handle can be screwed into the auxiliary handle receiving elements 56*a* for example by means of a screw connection for fixing the auxiliary handle on the gear housing 42*a*. The auxiliary handle extends transversely with respect to the main extension direction 48*a* of the right angle grinding tool 36*a* with the fastening region of the auxiliary handle mounted in an auxiliary handle receiving element 56*a*.

The machine tool switching device 10*a* includes a switching unit 14*a* which has a movably mounted control element 16*a* for actuating a mechanical, electric and/or electronic switching element 18*a* of the switching unit 14*a*. The control element 16*a* is arranged on the main handle 40*a* on a side of the main handle 40*a* facing the drive spindle 46*a*. As an alternative to this, the control element 16*a* could also be arranged on a side of the main handle 40*a* which is remote from the drive spindle 46*a* or on a different side which appears sensible to an expert. In particular, the main handle 40*a* could be rotatable in relation to the gear housing 42*a*. The control element 16*a* extends along a longitudinal direction 34*a* of the control element 16*a* which extends at least substantially parallel to the main extension direction 48 of the right angle grinding tool 36*a*, on the main handle 40*a* or on the motor housing 44*a*. In this case, an overall extension of the control element 16*a* along the longitudinal direction 34*a* corresponds to approximately 80% of an overall extension of the main handle 40*a* along a longitudinal direction 34*a*. The control element 16*a* has a control face 62*a* with an at least substantially rectangular projection face. The control face 62*a* is realized curved in a direction remote from the main handle 40*a*. A sealing element 134*a* of the right angle grinding tool 36*a* is arranged between the control element 16*a* and the main handle 40*a*, as a result of which an interior, which is surrounded by the main handle 40*a* or by the motor housing 44*a* is protected from ingress of dirt and/or of dust. The sealing element 134*a* is arranged in a groove in the main handle 40*a* or in the motor housing 44*a* facing the control element 16*a*. The switching element 18*a* is arranged in the interior which is surrounded by the main handle 40*a* or by the motor housing 44*a*. In this connection, the switching element 18*a* is arranged in a region of the interior which is arranged on a side of the main handle 40*a* or of the motor housing 44*a* which is remote from the gear housing 42*a*.

The control element 16*a* is mounted on the main handle 40*a* or on the motor housing 44*a* so as to be movable. In this connection, the control element 16*a* is mounted on the main handle 40*a* or on the motor housing 44*a* so as to be pivotable. The control element 16*a* has two bearing bolts 64*a*, 66*a* (FIG. 4) which are provided for the purpose of mounting the control element 16*a* so as to be pivotable about an axis 68*a*, which is aligned parallel to the main extension direction 48*a* of the right angle grinding tool 36*a*, in relation to the main handle 40*a* or to the motor housing 44*a*. The bearing bolts 64*a*, 66*a* are integrally molded onto the control element 16*a*. However, it is also conceivable for the bearing bolts 64*a*, 66*a* to be fixed on the control element 16*a* by means of a form-fitting and/or force-fitting connection. The main handle 40*a* or the motor housing 44*a* includes two bearing receiving means 70*a*, 72*a* in which the bearing bolts 64*a*, 66*a* are arranged in a mounted state of the control element 16*a*. The control element 16*a* is pivotable in part into the interior, which is surrounded by the main handle 40*a* or by the motor housing 44*a*, as a result of an interaction between the bearing bolts 64*a*, 66*a* and the bearing receiving means 70*a*, 72*a*. The switching unit 10*a* includes a spring element (not shown in any detail) which brings about a force onto the control element 14*a* in order, once an introduction of force from an operator onto the control element 16*a* is lifted, to pivot the control element 16*a* out of the interior into a starting position in which the switching element 18*a* of the control element 16*a* is not actuated. The control element 16*a* has a stop (not shown here in any detail) which, in a non-actuated state of the control element 16*a*, abuts against an inner wall of the main handle 40*a* or of the motor housing 44*a* which defines the interior which is surrounded by the main handle 40*a* or by the motor housing 44*a*. The stop prevents the control element 16*a* completely pivoting out of the interior, which is surrounded by the main handle 40*a* or by the motor housing 44*a*, as a result of a spring force of the spring element (not shown in any detail).

The control element 16*a* also has an actuating continuation 88*a* (FIG. 2) for actuating the mechanical, electric and/or electronic switching element 18*a* of the switching unit 14*a*. The actuating continuation 88*a* is provided for the purpose of actuating the switching element 18*a* as a result of a pivoting movement of the control element 16*a*. The actuating continuation 88*a* extends proceeding from the control element 16*a* into the interior which is surrounded by the main handle 40*a* or by the motor housing 44*a*. In addition, the actuating continuation 88*a*, in a mounted state of the control element 16*a*, is arranged on the control element 16*a* on a side of the control element 16*a* which is remote from the gear housing 42*a*. The switching element 18*a*, in this connection, is realized as an electric pressure switch.

In addition, the machine tool switching device 10*a* includes a blocking device 20*a* for blocking at least one movement of the control element 16*a*, which has a movably mounted release element 22*a* which is provided for the purpose of lifting the block of the control element 16*a*. The release element 22*a* is mounted so as to be movable in a translatory manner. In this connection, the release element 22*a* is mounted on the control element 16*a* so as to be movable in a translatory manner. Consequently, the release element 22*a* is realized as a slide switch. The release element 22*a* is arranged in part in a recess 58*a* of the control element 16*a*. Edge regions which define the recess 58*a* are in each case at the same distance to an edge of the control element 16*a* along the main extension direction 48*a*. Consequently, the recess 58*a* is arranged centrally and/or the release element 22*a* is arranged centrally in the control element 16*a* at least in one operating position.

Figure 2:
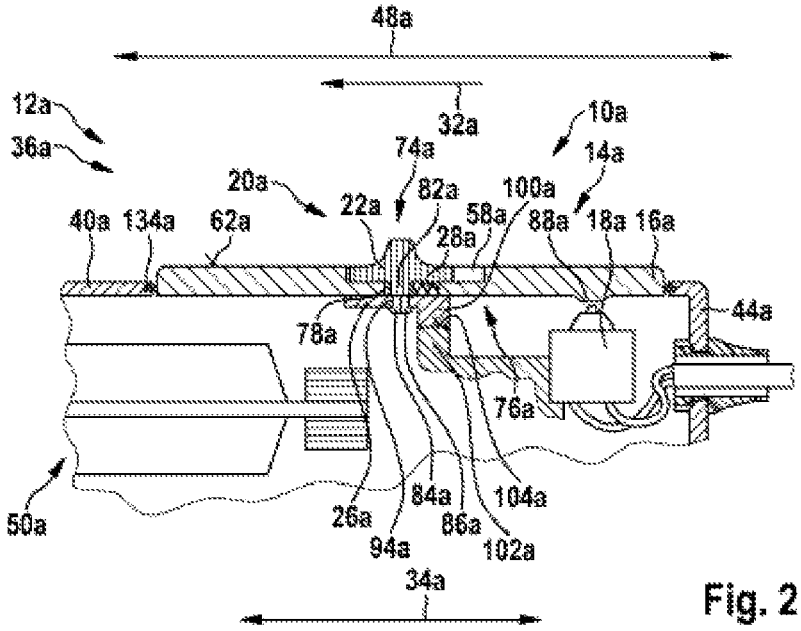
FIG. 2 shows a schematic representation of a view of a detail of the machine tool switching device according to the disclosure in a blocking position.
Figure 3:
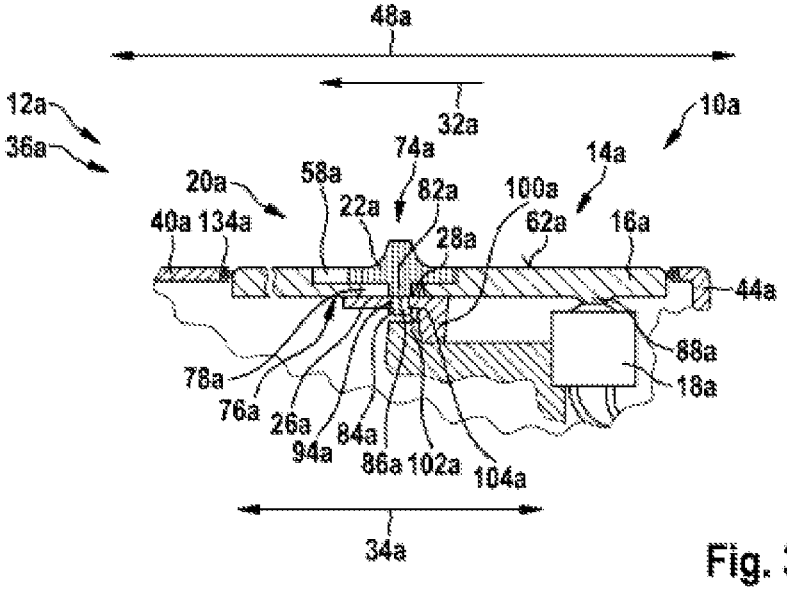
FIG. 3 shows a schematic representation of a view of a detail of the machine tool switching device according to the disclosure in a release position.
Figure 5:
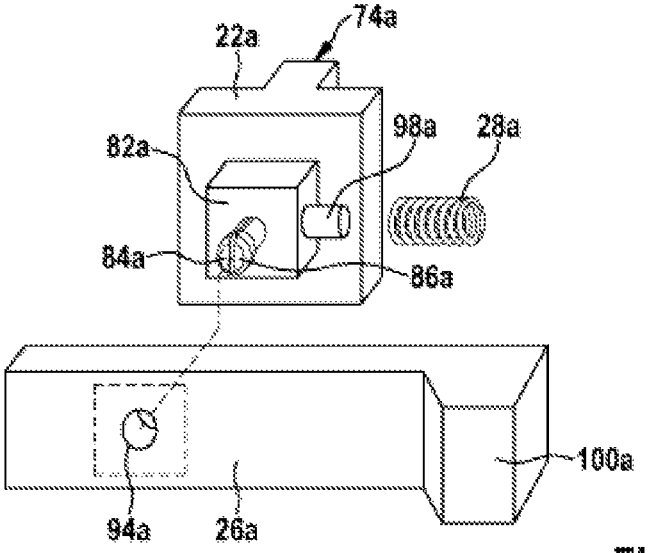
FIG. 5 shows a schematic representation of a view of a detail of a connection between a release element and a blocking element of the machine tool switching device according to the disclosure.

FIG. 2 shows an arrangement of the release element 22*a* in the recess 58*a* of the control element 16*a*. An actuating region 74*a* of the release element 22*a* extends along a direction which extends at least substantially at right angles to the control face 62*a* of the control element 16*a* beyond the control face 62*a*. A slot-shaped recess 78*a* is admitted in an edge region 76*a* of the control element 16*a* which defines the recess 58*a* with respect to the interior which is surrounded by the main handle 40*a* or by the motor housing 44*a*. The slot-shaped recess 78*a* is provided for the purpose of receiving a guide region 82*a* of the release element 22*a*. The guide region 82*a* extends, in this connection, through the slot-shaped recess 78*a* into the interior which is surrounded by the main handle 40*a* or by the motor housing 44*a*. Two fastening elements 84*a*, 86*a* of the release element 22*a* are arranged on the guide region 82*a*. The fastening elements 84*a*, 86*a* are realized integrally with the guide region 82*a*. The fastening elements 84*a*, 86*a* are realized as latching hooks (FIG. 5). However, it is also conceivable for more than two latching hooks to be arranged on the guide region 82*a* and/or for the fastening elements 84*a*, 86*a* to have a different development which appears sensible to an expert.

The latching device 20*a* has a blocking element 26*a* for blocking a movement of the control element 16*a* in dependence on a position of the release element 22*a*, which is fixed on the release element 22*a*. The blocking element 26*a*, in this connection, is fixed on the release element 22*a* by means of the fastening elements 84*a*, 86*a* which are realized as latching hooks. To this end, the latching element 26*a* has a connecting recess 94*a* which corresponds with the fastening elements 84*a*, 86*a* which are realized as latching hooks. The guide region 82*a*, with the blocking element 26*a* mounted on the release element 22*a*, extends into a recess (not shown here in any detail) of the blocking element 26*a* which corresponds with the guide region 82*a* in order to prevent the locking element 26*a* rotating in relation to the release element 22*a*. The fastening elements 84*a*, 86*a*, which are realized as latching hooks, engage behind the locking element 26*a* in a mounted state such that the locking element 26*a* is fixed on the release element 22*a* along a direction which extends at least substantially parallel to the main extension direction 48*a* and along a direction which extends at least substantially at right angles to the main extension direction 48*a*. However, it is also conceivable for the locking element 26*a* to have more than one recess to form a receiving means of fastening elements 84*a*, 86*a* of the release element 22*a*. The locking element 26*a*, along the longitudinal direction 34*a*, has an overall extension which corresponds to more than 70% of an overall extension of the release element 22*a* along the longitudinal direction 34*a*.

Figure 6:
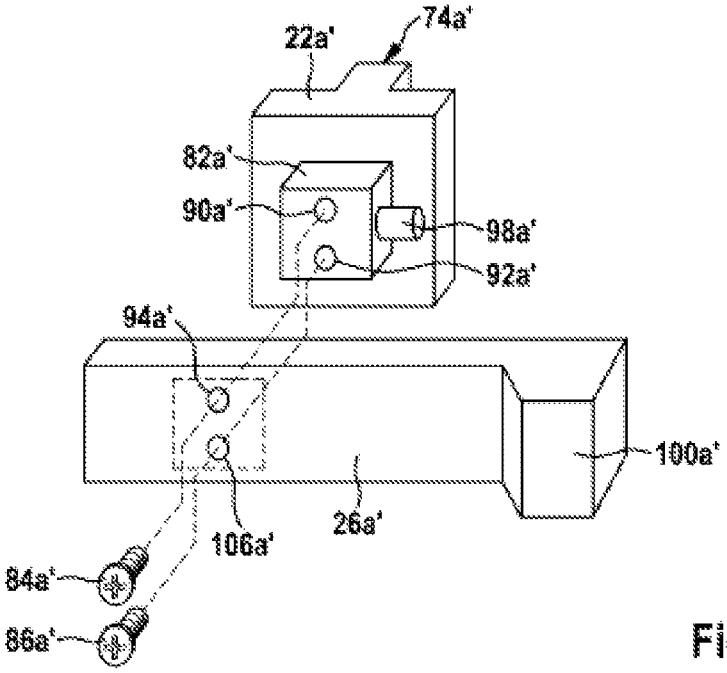
FIG. 6 shows a schematic representation of a view of a detail of an alternative connection between a release element and a blocking element of the machine tool switching device according to the disclosure.

FIG. 6 shows alternative fastening elements 84*a*', 86*a*'. The alternative fastening elements 84*a*', 86*a*' are realized as screws which are screwable into threaded bores 90*a*', 92*a*' of the release element 22*a*'. The threaded bores 90*a*', 92*a*' are provided in the guide region 82*a*' on a side of the guide region 82*a*' which faces the interior which is surrounded by the main handle 40*a* or the motor housing 44*a*. In this connection, the locking element 26*a*' has two connecting recesses 94*a*', 106*a*', through which the fastening elements 84*a*', 86*a*' which are realized as screws engage in a mounted state.

Figure 4:
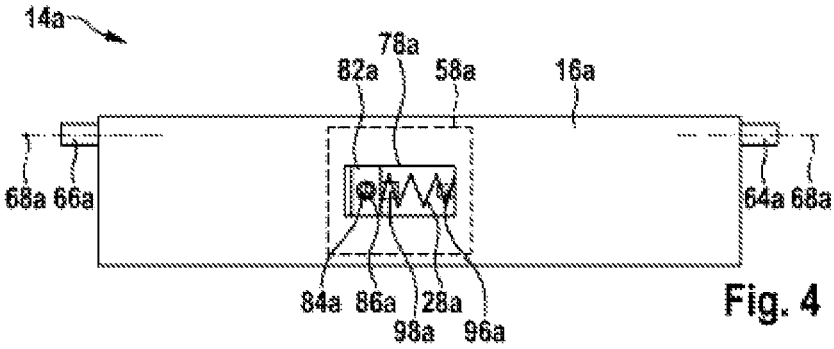
FIG. 4 shows a schematic representation of a view of a detail of an arrangement of the machine tool switching device according to the disclosure.

The blocking device 20*a* also includes a spring element 28*a* which is provided for the purpose of acting upon the release element 22*a* with a spring force at least in one direction 32*a*. The spring element 28*a*, in this connection, is realized as a compression spring, in particular as a helical compression spring. However, it is also conceivable for the spring element 28*a* to have a different development which appears sensible to an expert, such as, for example, as a tension spring, a torsion spring, etc. The spring element 28*a* is arranged in the slot-shaped recess 78*a* of the control element 16*a*. One end of the spring element 28*a* is arranged on a bolt-shaped holding element 96*a* of the control element 16*a*. The holding element 96*a* is realized integrally with the control element 16*a*. Another end of the spring element 28*a* is arranged on a bolt-shaped holding element 98*a* of the guide region 82*a* of the release element 22*a* (FIG. 4). Consequently, the spring element 28*a* is supported by way of one end on the control element 16*a* and by way of the other end on the release element 22*a*. The spring element 28*a* is provided for the purpose of acting upon the release element 22*a* and the blocking element 26*a* together with a spring force in the direction of a blocking position of the blocking element 26*a*.

In the blocking position of the blocking element 26*a*, the blocking element 26*a*, by way of a blocking continuation 100*a*, abuts against a stop face 104*a* of a stop 102*a* of the blocking device 20*a* which is arranged in the interior which is surrounded by the main handle 40*a* or by the motor housing 44*a* (FIG. 2). The blocking continuation 100*a* extends proceeding from the blocking element 26*a* in a direction which is remote from the release element 22*a*. The stop face 104*a* of the stop 102*a* is arranged on a side of the stop 102*a* which faces the control element 16*a*. The stop 102*a*, along the main extension direction 48*a*, is at a distance to the switching element 18*a* which corresponds approximately to an overall extension of the blocking element 26*a* along the longitudinal direction 34*a*. By means of the blocking continuation 100*a* abutting against the stop face 104*a* of the stop 102*a*, a movement of the control element 16*a* in the blocking position of the blocking element 26*a* is prevented as extensively as possible. Consequently, actuation of the switching element 18*a* is prevented by the actuating continuation 88*a* and the right angle grinding tool is stopped from starting up. However, it is also conceivable for the blocking element 26*a* to have two or several blocking continuations 100*a* which interact in each case with a stop face 104*a* of stops 102*a* in a blocking position of the blocking element 26*a* in order to prevent a movement of the control element 16*a* in the blocking position of the blocking element 26*a* as extensively as possible. In the case of an alternative development of the blocking element 26*a* (not shown here in any detail), the blocking element has two blocking continuations 100*a*. In this connection, one of the blocking continuations 100*a* is arranged on a region of the blocking element 26*a* which faces the gear housing 42*a* and one of the blocking continuations 100*a* is arranged on a region of the blocking element 26*a* which faces the switching element 18*a*. The blocking continuations 100*a* interact in a locking position of the locking element 26*a* with stop faces 104*a* of stops 102*a* which are arranged in the interior which is surrounded by the main handle 40*a* or the motor housing 44*a*.

To start up the right angle grinding tool 36*a*, an operator has to move the release element 22*a* and the blocking element 26*a* out of the blocking position of the blocking element 26*a*. In this connection, an operator moves the release element 22*a* in a translatory manner in the control element 16*a*, in particular in a direction which is remote from the gear housing 42*a*. However, it is also conceivable for the operator to have to move the release element 22*a* in a different direction which appears sensible to an expert in order to move the blocking element 26*a* out of the blocking position, such as, for example, in a direction which faces the gear housing 42*a*. The movement of the release element 22*a* also moves the blocking element 26*a*, as a result of the fixing of the locking element 26*a* by means of the fastening elements 84*a*, 86*a* on the release element 22*a*, in a translatory manner in a direction which is remote from the gear housing 42*a*. The blocking continuation 100*a* of the blocking element 26*a* is consequently moved away from the stop face 104*a* of the stop 102*a*. As a result, a possibility of movement of the control element 16*a* in the direction of the switching element 18*a* is released. The operator can now start up the right angle grinding tool 36*a* as a result of an introduction of force onto the control element 16*a* in the direction of the switching element 16*a*. In this connection, the switching element 18*a* is actuated by means of the actuating continuation 88*a* of the control element 16*a*, whereupon a circuit to a power supply of the drive unit 50*a* which is realized as an electric motor is closed. Once the operator has stopped introducing force onto the control element 16*a* in the direction of the switching element 18*a*, the control element 16*a* is moved by means of the spring element (not shown in any detail) in a direction which is remote from the switching element 18*a*. In this connection, the release element 22*a* is moved together with the blocking element 26*a* in the direction of the blocking position of the blocking element 26*a* by means of a spring force of the spring element 28*a* which is arranged between the control element 18*a* and the release element 22*a*. Consequently, the blocking element 26*a* passes back into contact with the stop face 104*a* of the stop 102*a* which faces the control element 18*a* and blocks a movement of the control element 16*a* in the direction of the switching element 18*a* as extensively as possible.

FIGS. 7 to 10 show alternative exemplary embodiments. Components, features and functions which substantially remain the same are in principle numbered with the same references. To differentiate between the exemplary embodiments, the letters a to e are added to the references of the exemplary embodiments. The following description is essentially restricted to the differences to the first exemplary embodiment in FIGS. 1 to 6, it being possible to refer to the description of the first exemplary embodiment with reference to components, features and functions which remain the same.

Figure 7:
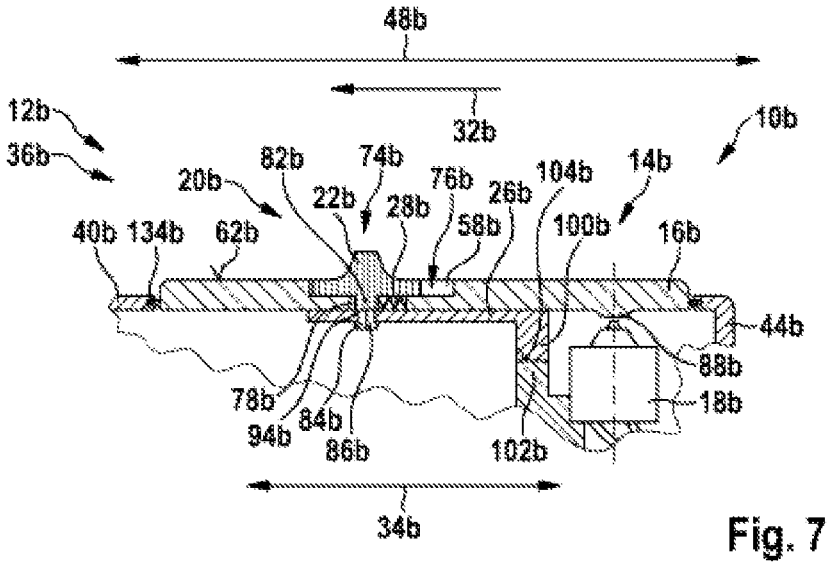
FIG. 7 shows a schematic representation of a view of a detail of an alternative machine tool switching device according to the disclosure in a blocking position.

FIG. 7 shows an alternative machine tool switching device 10*b* of a portable machine tool 12*b*. The portable machine tool 12*b* has a design which is analogous to the portable machine tool 12*a* described in FIGS. 1 to 6. The machine tool switching device 10*b* includes a switching unit 14*b* which has a movably mounted control element 16*b* for actuating a mechanical, electric and/or electronic switching element 18*b*, and a blocking device 20*b* for blocking at least one movement of the control element 16*b* which has a movably mounted release element 22*b* which is provided for the purpose of lifting the block of the control element 16*b*. The release element 22*b* is mounted so as to moveable in a translatory manner in a recess 58*b* of the control element 16*b*. The blocking device 20*b* has a blocking element 26*b* for blocking a movement of the control element 16*b* in dependence on a position of the release element 22*b*, said blocking element being fixed on the release element 22*b*. The blocking element 26*b*, along a longitudinal direction 34*b* of the control element 16*b*, has an overall extension which is approximately double the size of an overall extension of the release element 22*b* along the longitudinal direction 34*b*. The blocking element 26*b*, in a blocking position, abuts against a stop face 104*b* of a stop 102*b* of the blocking device 20*b*. The stop 102*b* is at a distance to the switching element which corresponds to approximately 20% of the overall extension of the release element 22*b* along the longitudinal direction 34*b*. Reference may be made essentially to the description of FIGS. 1 to 6 with reference to function, design, and arrangement of the individual elements, components, units and devices.

Figure 8:
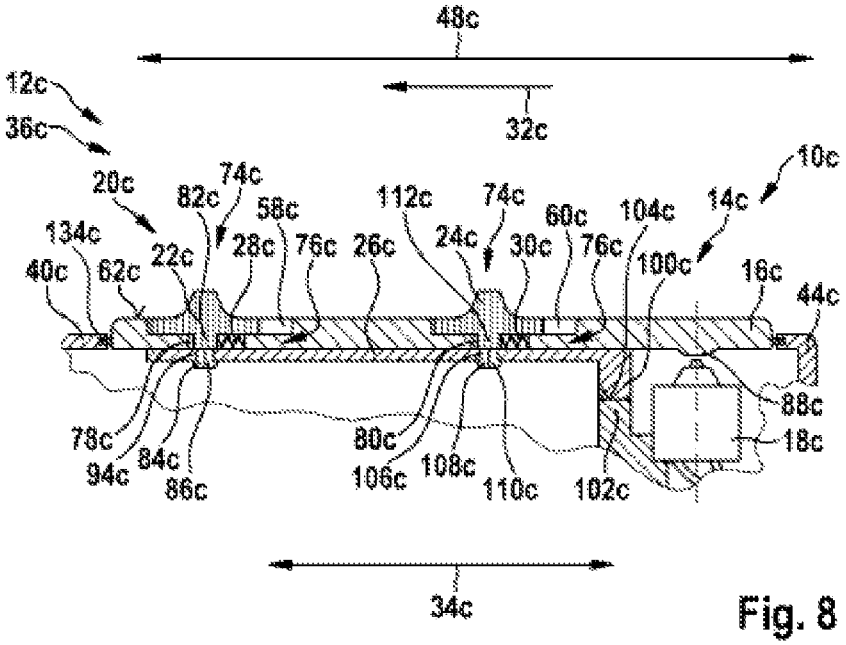
FIG. 8 shows a schematic representation of a view of a detail of a further alternative machine tool switching device according to the disclosure in a blocking position.

FIG. 8 shows a further alternative machine tool switching device 10*c* of a portable machine tool 12*c*. The portable machine tool 12*c* has a design which is analogous to the portable machine tool 12*a* described in FIGS. 1 to 6. The machine tool switching device 10*c* includes a switching unit 14*c* which has a movably mounted control element 16*c* for actuating a mechanical, electric and/or electronic switching element 18*c*, and a blocking device 20*c* for blocking at least one movement of the control element 16*c* which has a movably mounted release element 22*b* which is provided for the purpose of lifting the block of the control element 16*c*. In addition, the blocking device 20*c* has a further release element 24*c* which is arranged together with the release element 22*c* on the control element 16*c* so as to be movable in a translatory manner. The release elements 22*c*, 24*c* are mounted so as to moveable in a translatory manner in recesses 58*c*, 60*c* of the control element 16*c*. The recesses 58*c*, 60*c* are arranged spaced apart in relation to one another along a longitudinal direction 34*c* of the control element 16*c*. The blocking device 20*c* has a blocking element 26*c* for blocking a movement of the control element 16*c* in dependence on a position of the release elements 22*c*, 24*c*, said control element being fixed on the release elements 22*c*, 24*c*. In this connection, the blocking element 26*c* has two connecting recesses 94*c*, 106*c* in which fastening elements 84*c*, 86*c*, 108*c*, 110*c* of the release elements 22*c*, 24*c*, which are realized as latching hooks, engage and fix the blocking element 26*c* on the release elements 22*c*, 24*c*. In addition, the blocking device 20*c* has two spring elements 28*c*, 30*c* which are provided for the purpose of acting upon the release elements 22*c*, 24*c* with a spring force at least in one direction 32*c*. Reference may be made essentially to the description of FIGS. 1 to 6 with reference to function, design, and arrangement of the individual elements, components, units and devices.

Figure 9:
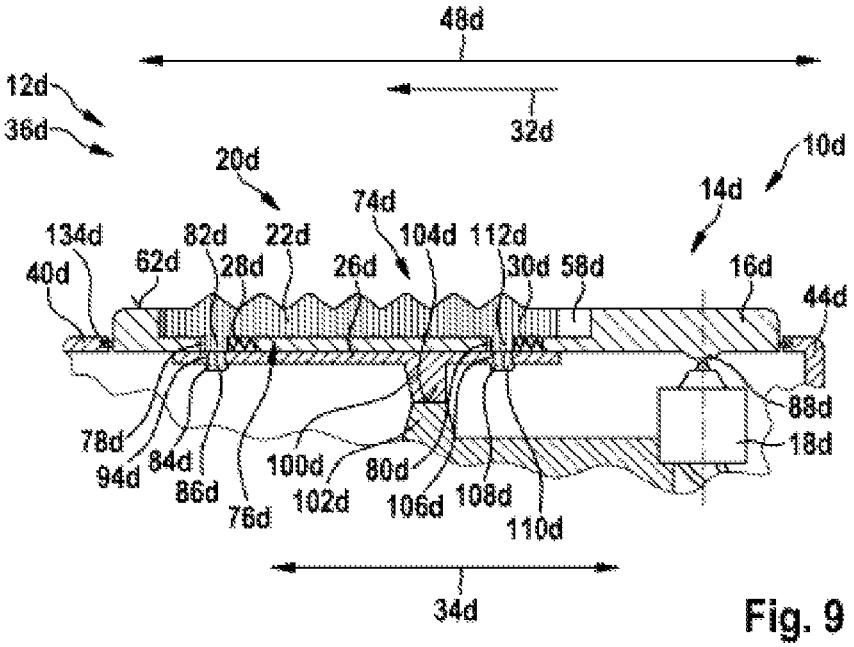
FIG. 9 shows a schematic representation of a view of a detail of a further alternative machine tool switching device according to the disclosure in a blocking position and FIG. 10 shows a schematic representation of a view of a detail of a further alternative machine tool switching device according to the disclosure in a blocking position.

FIG. 9 shows a further alternative machine tool switching device 10*d* of a portable machine tool 12*d*. The portable machine tool 12*d* has a design which is analogous to the portable machine tool 12*a* described in FIGS. 1 to 6. The machine tool switching device 10*d* includes a switching unit 14*d* which has a movably mounted control element 16*d* for actuating a mechanical, electric and/or electronic switching element 18*d*, and a blocking device 20*d* for blocking at least one movement of the control element 16*d* which has a movably mounted release element 22*d* which is provided for the purpose of lifting the block of the control element 16*d*. The release element 22*d* is mounted so as to movable in a translatory manner in a recess 58*d* of the control element 16*d*. The blocking device 20*d* has a blocking element 26*d* for blocking a movement of the control element 16*d* in dependence on a position of the release element 22*d*, said control element being fixed on the release element 22*d*. The release element 22*d* has an extension along a longitudinal direction 34*d* of the control element 16*d* which is greater than 20% of an overall extension of the control element 16*d* along the longitudinal direction 34*d*. In particular, the release element 22*d* has an extension along the longitudinal direction 34*d* which is greater than 40% of an overall extension of the control element 16*d* along the longitudinal direction 34*d*.

The release element 22*d* also has a ribbed surface structure on a side of the release element 22*d* which is remote from the blocking element 26*d* in order to achieve a high level of grip for actuation by means of a hand and/or a finger of an operator. In addition, the release element 22*d* has two guide regions 82*d*, 112*d* which are arranged spaced apart in relation to one another along the longitudinal direction 34*d*. The guide regions 82*d*, 112*d* are in each case arranged in a slot-shaped recess 78*d*, 80*d* in the control element 16*d*. The blocking element 26*d* has two connecting recesses 94*d*, 106*d* in which fastening elements 84*d*, 86*d*, 108*d*, 110*d* of the release element 22*d*, which are realized as latching hooks, engage for fixing the blocking element 26*d* on the release element 22*d*. A blocking continuation 100*d* of the blocking element 26*d*, in this connection, is arranged along the longitudinal direction 34*d* between the connecting recesses 94*d*, 106*d*. In addition, the blocking device 20*d* has two spring elements 28*d*, 30*d* which are provided for the purpose of acting upon the release element 22*d* with a spring force at least in one direction 32*d*. Reference may be made essentially to the description of FIGS. 1 to 6 with reference to function, design, and arrangement of the individual elements, components, units and devices.

Figure 10:
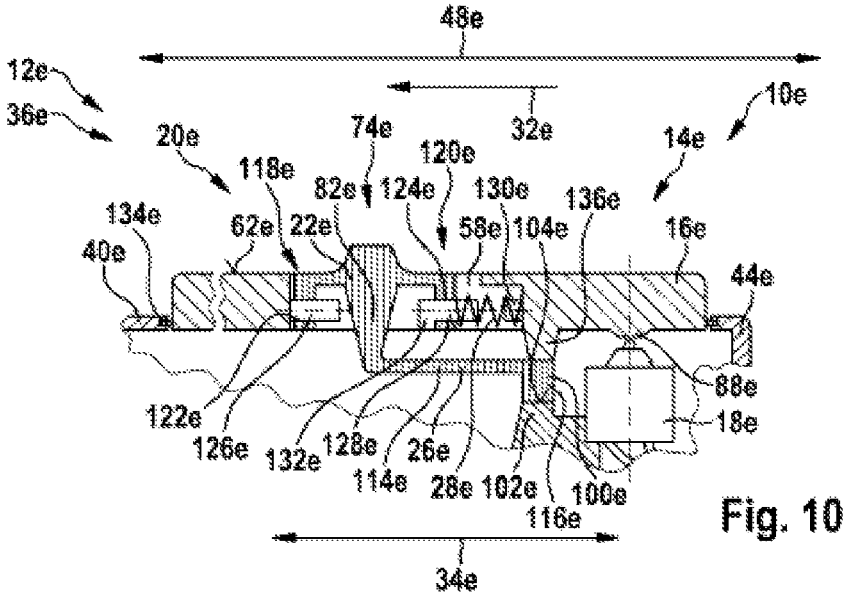

FIG. 10 shows a further alternative machine tool switching device 10*e* of a portable machine tool 12*e*. The portable machine tool 12*e* has a design which is analogous to the portable machine tool 12*a* described in FIGS. 1 to 6. The machine tool switching device 10*e* includes a switching unit 14*e* which has a movably mounted control element 16*e* for actuating a mechanical, electric and/or electronic switching element 18*e*, and a blocking device 20*e* for blocking at least one movement of the control element 16*e* which has a movably mounted release element 22*e* which is provided for the purpose of lifting the block of the control element 16*e*. The release element 22*e* is mounted so as to moveable in a translatory manner in a recess 58*e* of the control element 16*e*. In this connection, the release element 22*e* has two bearing arrangement regions 118*e*, 120*e* in which, in each case, a bearing arrangement recess 122*e*, 124*e* of the release element 22*e* is arranged. The bearing arrangement recesses 122*e*, 124*e* are provided for the purpose of interacting with guide bolts 126*e*, 128*e* of the control element 16*e* in a mounted state of the release element 22*e*. The guide bolts 126*e*, 128*e* are arranged in the recess 58*e*. One of the guide bolts 126*e*, 128*e*, in this connection, is integrally molded on an edge region of the control element 16*e* which defines the recess 58*e*. Another of the guide bolts 128*e* is integrally molded on a web-shaped stabilizing element 132*e*, which extends at least substantially at right angles to a longitudinal direction 34*e* of the control element 16*e*. In this connection, the stabilizing element 132*e* extends transversely inside the recess 58*e*. In addition, a spring element 28*e* of the blocking device 20*e* is arranged by way of one end on the guide bolt 128*e* which is integrally molded on the stabilizing element 132*e* and by way of another end on a guide bolt 130*e* which is integrally molded on a further edge region which defines the recess 58*e*. The spring element 28*e* is provided for the purpose of acting upon the release element 22*e* with a spring force at least in one direction 32*e*.

The blocking device 20*e* has a blocking element 26*e* for blocking a movement of the control element 16*e* in dependence on a position of the release element 22*e*, said control element being fixed on the release element 22*e*. In this connection, the blocking element 26*e* is realized integrally with the release element 22*e*. In addition, the blocking element 26*e* has an L-shaped development. A first leg 114*e* of the blocking element 26*e* extends in a mounted state of the release element 22*e* at least substantially parallel to a longitudinal direction 34*e* of the control element 16*e*. A second leg 116*e* extends at least substantially at right angles to the first leg 114*e*. The second leg 116*e* forms a blocking continuation 100*e* which is provided for the purpose of interacting with a stop 102*e* of the blocking device 20*e* for blocking a movement of the control element 16*e*. In addition, the blocking continuation 100*e* interacts with a transmission continuation 136*e* of the control element 16*e* on a side of the blocking element 26*e* which is remote from the stop 102*e*. The transmission continuation 136*e* is provided for the purpose of transmitting a force onto the blocking continuation 100*e* when an operator introduces a force onto the control element 16*e* in a blocking position of the blocking element 26*e* in order to prevent a movement of the control element 16*e* in as extensive a manner as possible. The transmission continuation 136*e* extends proceeding from the control element 16*e* in the direction of the stop 102*e*. In this connection, the transmission continuation 136*e* is realized integrally with the control element 16*e*. However, it is also conceivable for the transmission continuation 136*e* to be fixed on the control element 16*e* by means of a form-fitting and/or by means of a force-fitting connection. Reference may be made essentially to the description of FIGS. 1 to 6 with reference to function, design, and arrangement of the individual elements, components, units and devices.

The invention claimed is:

1. A machine tool switching device, comprising:

at least one switching unit having at least one movably mounted control element configured to actuate one or more of a mechanical switching element, an electric switching element, and an electronic switching element; and at least one blocking device configured to block at least one movement of the control element, said blocking device having at least one movably mounted release element configured to lift the block of the control element, wherein the release element is mounted on the control element so as to be movable with the control element and to be movable relative to the control element in a translatory manner.

2. The machine tool switching device of claim 1, wherein the release element is arranged at least in part in a recess of the control element.

3. The machine tool switching device of claim 1, wherein the blocking device has at least one blocking element configured to block a movement of the control element in dependence on a position of the release element, said blocking element being fixed on the release element.

4. The machine tool switching device of claim 3, wherein the blocking element is configured integrally with the release element.

5. The machine tool switching device of claim 1, wherein the blocking device has at least one spring element configured to act upon the release element with a spring force at least in one direction.

6. The machine tool switching device of claim 1, wherein the blocking device has at least one further release element arranged together with the release element on the control element so as to be movable in a translatory manner.

7. The machine tool switching device of claim 1, wherein, along a longitudinal direction of the control element, the release element has an extension which is greater than 20% of an overall extension of the control along the longitudinal direction.

8. The machine tool switching device of claim 1, wherein the control element is pivotably mounted.

9. The machine tool switching device of claim 1, wherein the machine tool switching device is configured for portable machine tools.

10. The machine tool switching device of claim 1, wherein the blocking device includes at least one further release element arranged together with said release element on said control element so as to be movable in a translatory manner relative to said control element, said release element and said further release element each having at least one actuating surface.

11. A portable machine tool, comprising:

at least one machine tool switching device including:

at least one switching unit having at least one movably mounted control element configured to actuate one or more of a mechanical switching element, an electric switching element, and an electronic switching element; and at least one blocking device configured to block at least one movement of the control element, said blocking device having at least one movably mounted release element configured to lift the block of the control element, wherein the release element is mounted on the control element so as to be movable with the control element and to be movable relative to the control element in a translatory manner.

12. The portable machine tool of claim 11, wherein the portable machine tool is configured as a right angle grinding tool.

13. A machine tool switching device, comprising:

at least one switching unit having at least one movably mounted control element configured to actuate one or more of a mechanical switching element, an electric switching element, and an electronic switching element, said control element having a control face for engagement to actuate the switching element and a recess defined in said control face; and at least one blocking device configured to block at least one movement of the control element, said blocking device having at least one movably mounted release element configured to lift the block of the control element, wherein the release element is mounted on the control element so as to be movable relative to the control element in a translatory manner, and wherein the release element is arranged at least in part in said recess of said control element.

14. The machine tool switching device of claim 13, wherein the blocking device has at least one blocking element configured to block a movement of the control element in dependence on a position of the release element, said blocking element being fixed on the release element.

15. The machine tool switching device of claim 14, wherein the blocking element is configured integrally with the release element.

16. The machine tool switching device of claim 13, wherein the blocking device has at least one spring element configured to act upon the release element with a spring force at least in one direction.

17. The machine tool switching device of claim 13, wherein the blocking device has at least one further release element arranged together with the release element on the control element so as to be movable in a translatory manner.

18. The machine tool switching device of claim 13, wherein, along a longitudinal direction of the control element, the release element has an extension which is greater than 20% of an overall extension of the control along the longitudinal direction.

19. The machine tool switching device of claim 13, wherein the control element is pivotably mounted.

20. A machine tool switching device, comprising: at least one switching unit having at least one movably mounted control element configured to actuate one or more of a mechanical switching element, an electric switching element, and an electronic switching element; and at least one blocking device having at least one blocking element configured to block at least one movement of the control element, said blocking device including at least one movably mounted release element configured to lift the at least one blocking element to block a movement of the control element in dependence on a position of the release element, wherein said blocking element is fixed on the release element, wherein the release element is mounted on the control element so as to be movable relative to the control element in a translatory manner, said release element having at least one actuating surface, and wherein the release element is arranged at least in part in a recess redefined is said control element.

* * * * *